US010665399B2

(12) United States Patent
Yamada et al.

(10) Patent No.: US 10,665,399 B2
(45) Date of Patent: May 26, 2020

(54) GAS CIRCUIT BREAKER

(71) Applicant: Mitsubishi Electric Corporation, Chiyoda-ku, Tokyo (JP)

(72) Inventors: Daisaku Yamada, Tokyo (JP); Masataka Adachi, Tokyo (JP); Yasunori Nakamura, Tokyo (JP); Yuji Yoshitomo, Tokyo (JP); Daisuke Yoshida, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 16/347,051

(22) PCT Filed: Feb. 20, 2017

(86) PCT No.: PCT/JP2017/006079
§ 371 (c)(1),
(2) Date: May 2, 2019

(87) PCT Pub. No.: WO2018/150564
PCT Pub. Date: Aug. 23, 2018

(65) Prior Publication Data

US 2019/0362913 A1 Nov. 28, 2019

(51) Int. Cl.
*H01H 9/38* (2006.01)
*H01H 9/30* (2006.01)

(52) U.S. Cl.
CPC ..... *H01H 9/383* (2013.01); *H01H 9/302* (2013.01); *H01H 9/386* (2013.01)

(58) Field of Classification Search
CPC ..... H01H 9/302; H01H 9/383; H01H 9/386; H01H 33/56; H01H 33/565;
(Continued)

(56) References Cited

U.S. PATENT DOCUMENTS 4,229,627 A * 10/1980 Rostron ..... H01H 33/76 218/63
4,339,641 A * 7/1982 Noeske ..... H01H 33/7023 218/64
(Continued)

FOREIGN PATENT DOCUMENTS

CN 101901719 A 12/2010
DE 102015205388 A1 9/2016
(Continued)

OTHER PUBLICATIONS

International Search Report (PCT/ISA/210) and Written Opinion (PCT/ISA/237) dated May 23, 2017, by the Japan Patent Office as the International Searching Authority for International Application No. PCT/JP2017/006079.
(Continued)

*Primary Examiner* — William A Bolton
(74) *Attorney, Agent, or Firm* — Buchanan Ingersoll & Rooney PC

(57) ABSTRACT

A gas circuit breaker includes: a fixed arc contact extending along an operating axis; a moving arc contact allowed to move to a position where the moving arc contact contacts the fixed arc contact and a position where the moving arc contact is separated from the fixed arc contact; a frame forming a puffer chamber around the moving arc contact; a nozzle having a cylindrical shape centered on the operating axis, the nozzle being fixed to the frame and projecting in a direction toward the fixed arc contact from the moving arc contact; and an arc extinction assisting portion provided on an inner surface of the nozzle and made of an ablation material. The nozzle and the arc extinction assisting portion are provided with a fall-off preventing portion to prevent the arc extinction assisting portion from falling off the nozzle.

9 Claims, 7 Drawing Sheets

(58) Field of Classification Search
CPC ..... H01H 33/7023; H01H 33/7038; H01H 33/76; H01H 33/765; H01H 33/95; H01H 33/88; H01H 1/38
USPC ..... 218/54, 57, 59, 62, 63, 64, 72, 73, 51
See application file for complete search history.

(56) References Cited

U.S. PATENT DOCUMENTS

| | | | | | |
|---|---|---|---|---|---|
| 4,553,008 | A * | 11/1985 | Veverka | H01H 33/88 | 218/117 |
| 5,925,863 | A * | 7/1999 | Zehnder | H01H 33/7023 | 218/53 |
| 8,115,133 | B2 * | 2/2012 | Uchii | H01H 33/7076 | 218/116 |
| 2015/0021297 | A1 * | 1/2015 | Stoller | H01H 33/7023 | 218/51 |
| 2015/0380188 | A1 * | 12/2015 | Sakuyama | H01H 33/74 | 218/46 |

FOREIGN PATENT DOCUMENTS

| | | | |
|---|---|---|---|
| EP | 2360707 | A1 | 8/2011 |
| JP | 49078766 | U | 7/1974 |
| JP | 03078925 | A | 4/1991 |
| JP | H04-315721 | A | 11/1992 |
| JP | 09063432 | A | 3/1997 |
| JP | 2007073384 | A | 3/2007 |

OTHER PUBLICATIONS

Extended European Search Report dated Jan. 24, 2020 for corresponding European patent application No. 17896477.1, 10 pages.

* cited by examiner

GAS CIRCUIT BREAKER

FIELD

The present invention relates to a gas circuit breaker including a fixed arc contact and a moving arc contact in a tank filled with an insulating gas.

BACKGROUND

In gas circuit breakers, a fixed arc contact and a moving arc contact are provided in a tank filled with an insulating gas. By allowing the moving arc contact to move to a position where the moving arc contact contacts the fixed arc contact and a position where the moving arc contact is separated from the fixed arc contact, current can be injected into the conductors provided in the tank and the current flowing to the conductors can be interrupted.

When current is injected or interrupted, the gas circuit breaker blows an insulating gas in the tank to an arc generated between the moving arc contact and the fixed arc contact so as to extinguish the arc. Hence, a puffer chamber that stores gas to be blown to the arc is provided around the moving arc contact. By increasing the gas pressure of the insulating gas in the puffer chamber upon generation of an arc, a high-pressure insulating gas is blown to the arc. A higher gas pressure in the puffer chamber upon generation of an arc results in a higher arc-extinguishing performance and thus a higher current interruption performance of the gas circuit breaker.

Hence, an arc extinction assisting portion formed of an ablation material, such as perfluoroether-based polymers, that evaporates by the heat generated upon generation of an arc may be provided in the tank. When the arc extinction assisting portion evaporates upon generation of an arc and evaporative gas generated is taken into the puffer chamber, the gas pressure in the puffer chamber is increased. Consequently, the arc-extinguishing performance of the gas circuit breaker is improved. It is said in general that the arc-extinguishing performance is improved by providing an arc extinction assisting portion near the arc generation point. Patent Literature 1 discloses a technique in which an arc extinction assisting portion is provided in part of a nozzle placed near the arc generation point.

CITATION LIST

Patent Literature

Patent Literature 1: Japanese Patent Application Laid-open No. H3-78925

SUMMARY

Technical Problem

However, a supersonic gas flow occurs in the arc generation point. Hence, there is a possibility that the arc extinction assisting portion provided near the arc generation point may fall off the nozzle due to the impact of the supersonic gas flow.

The present invention is made in view of the above description, and an object of the present invention is to obtain a gas circuit breaker in which an arc extinction assisting portion is provided on a nozzle near an arc generation point such that the arc extinction assisting portion is less likely to fall off the nozzle.

Solution to Problem

To solve the aforementioned problem and attain the object, the present invention includes a fixed arc contact extending along an operating axis; a moving arc contact allowed to move to a position where the moving arc contact contacts the fixed arc contact and a position where the moving arc contact is separated from the fixed arc contact by moving along the operating axis; a frame that forms a puffer chamber around the moving arc contact by enclosing an area around the moving arc contact; a nozzle fixed to the frame and projecting in a direction more on a fixed arc contact side than the moving arc contact, the nozzle forming a cylindrical shape with the operating axis being at a center of the cylindrical shape; and an arc extinction assisting portion provided on an inner surface of the nozzle and made of an ablation material. A fall-off preventing portion that prevents the arc extinction assisting portion from falling off the nozzle is provided to the nozzle and the arc extinction assisting portion.

Advantageous Effects of Invention

With the gas circuit breaker according to the present invention, an advantageous effect is obtained where an arc extinction assisting portion can be provided on a nozzle near an arc generation point such that the arc extinction assisting portion is less likely to fall off the nozzle.

DESCRIPTION OF EMBODIMENTS

Gas circuit breakers according to embodiments of the present invention will be described in detail below with reference to the drawings. Note that the invention is not limited to the embodiments.

First Embodiment

Figure 1:
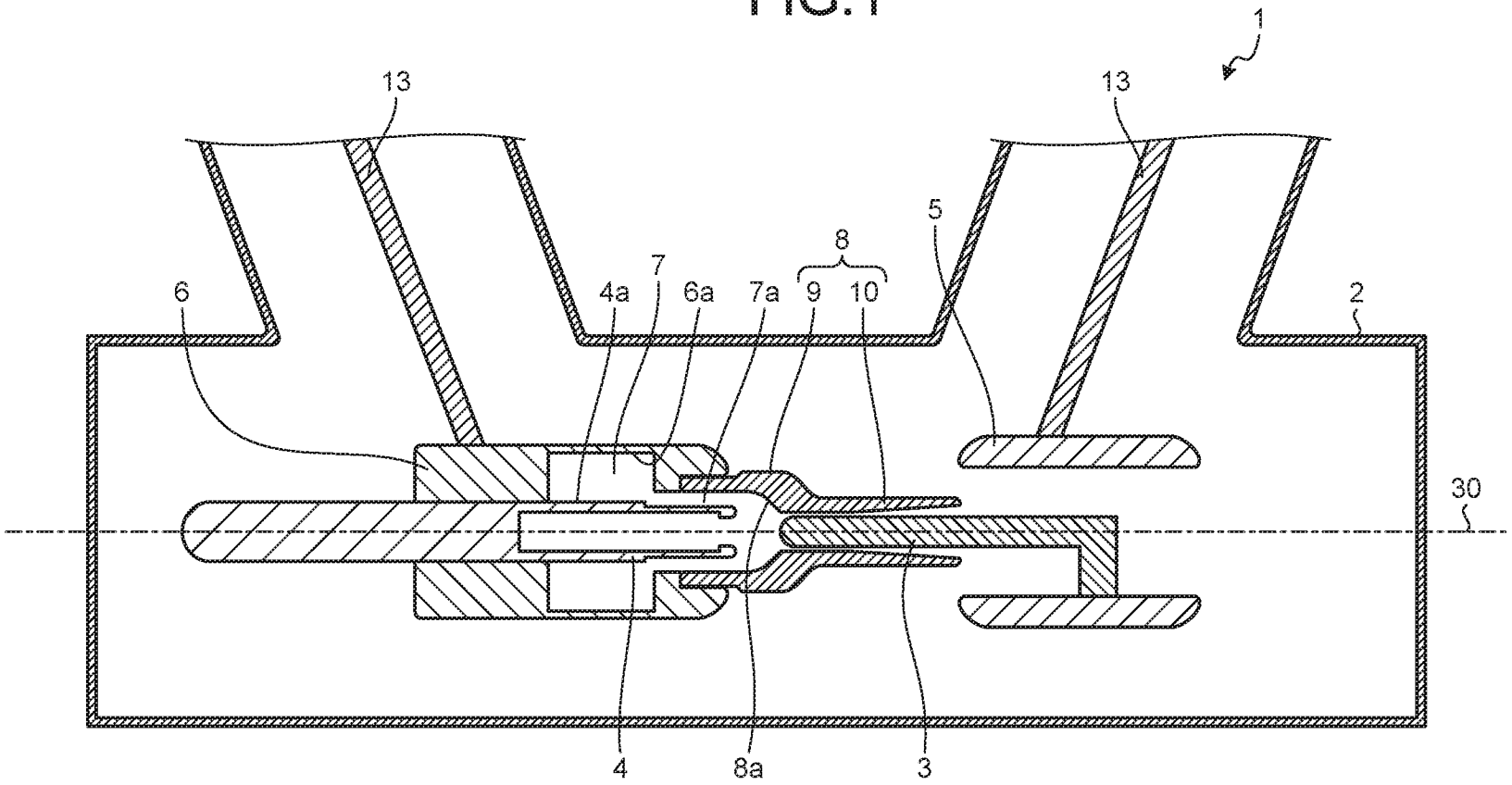
FIG. 1 is a cross-sectional view of a gas circuit breaker according to a first embodiment of the present invention.

FIG. 1 is a cross-sectional view of a gas circuit breaker according to a first embodiment of the present invention.

Figure 2:
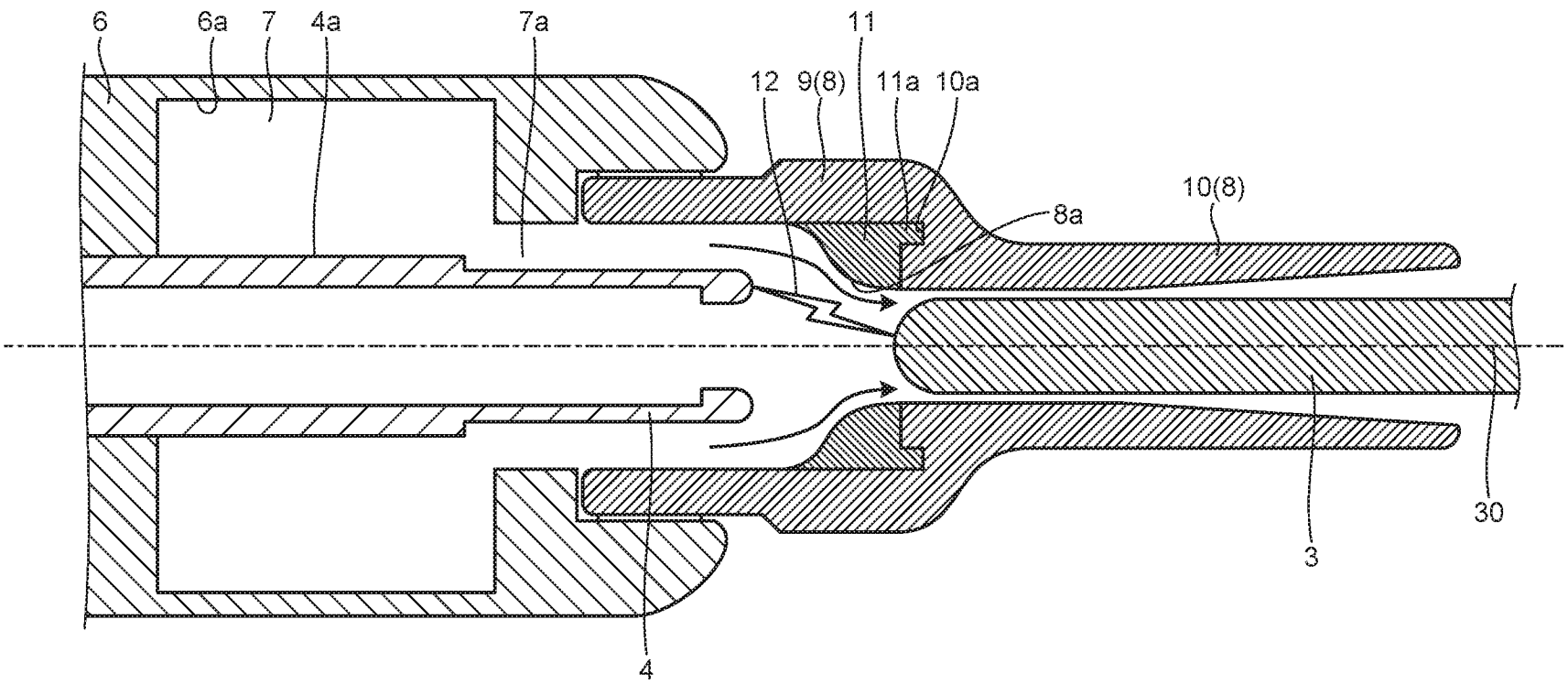
FIG. 2 is a partially enlarged cross-sectional view of a contact portion between a fixed arc contact and a moving arc contact according to the first embodiment.

FIG. 2 is a partially enlarged cross-sectional view of a contact portion between a fixed arc contact and a moving arc contact according to the first embodiment. A gas circuit breaker 1 includes a tank 2 filled with an insulating gas having electrical insulation properties and arc-extinguishing properties, such as a sulfur hexafluoride ($SF_6$) gas. The tank 2 is, for example, a container made of metal. The gas circuit breaker 1 includes a fixed arc contact 3 accommodated in the tank 2 and a moving arc contact 4 accommodated in the tank 2.

The fixed arc contact 3 has a rod-like shape extending along an operating axis 30. The fixed arc contact 3 is formed of, for example, a metal conductor. The gas circuit breaker 1 includes a fixed-side frame 5 formed of, for example, a metal conductor. The fixed arc contact 3 placed in the tank 2 is fixed to the fixed-side frame 5 provided in the tank 2.

The moving arc contact 4 has a cylindrical shape extending along the operating axis 30. The moving arc contact 4 is formed of, for example, a metal conductor. The moving arc contact 4 is supported so as to be movable along the operating axis 30 in the tank 2. The moving arc contact 4 moves along the operating axis 30 such that it can move to the position where the moving arc contact 4 contacts the fixed arc contact 3 and to the position where the moving arc contact 4 is separated from the fixed arc contact 3.

The gas circuit breaker 1 includes a movable-side frame 6 that surrounds the circumference of the moving arc contact 4. The movable-side frame 6 has a cylindrical shape and surrounds the circumference of the moving arc contact 4. The movable-side frame 6 is coupled to the moving arc contact 4 and thus moves with the moving arc contact 4 along the operating axis 30.

The movable-side frame 6 forms a puffer chamber 7 around the moving arc contact 4. The puffer chamber 7 is a space formed around the moving arc contact 4 and surrounded by an inner surface 6*a* of the movable-side frame 6 and an outer surface 4*a* of the moving arc contact 4. The puffer chamber 7 has an opening 7*a* formed in its wall surface near the fixed arc contact 3.

The gas circuit breaker 1 includes a nozzle 8 fixed to the movable-side frame 6. The nozzle 8 has a cylindrical shape centered on the operating axis 30, and it projects in a direction toward the fixed arc contact 3 from the moving arc contact 4. The space inside the nozzle 8 communicates with the opening 7*a* of the puffer chamber 7. The nozzle 8 is fixed to the movable-side frame 6 that moves with the moving arc contact 4. Thus, the nozzle 8 also moves with the moving arc contact 4.

The nozzle 8 includes a fixed portion 9 that is a portion fixed to the movable-side frame 6 and a throat portion 10 extending from the fixed portion 9 toward a side where the fixed arc contact 3 is present along the operating axis 30. The inner diameter of the throat portion 10 is smaller than the inner diameter of the fixed portion 9. The interior wall of the nozzle 8 has a connecting surface 8*a* formed thereon that smoothly connects the interior walls of the throat portion 10 and the fixed portion 9 that have different inner diameters.

The throat portion 10 is formed such that its inner diameter allows the fixed arc contact 3 to pass through the throat portion 10. Thus, when the moving arc contact 4 moves toward the fixed arc contact 3, the fixed arc contact 3 is inserted into the nozzle 8 and then, the moving arc contact 4 and the fixed arc contact 3 come into contact with each other.

An arc extinction assisting portion 11 is provided in the nozzle 8. In the first embodiment, the arc extinction assisting portion 11 is provided inside the nozzle 8 and at the connecting portion between the fixed portion 9 and the throat portion 10. Part of the arc extinction assisting portion 11 forms the connecting surface 8*a*.

The arc extinction assisting portion 11 is formed of an ablation material that evaporates by the heat of an arc generated between the fixed arc contact 3 and the moving arc contact 4 and thereby generates evaporative gas. Examples of the ablation material include polytetrafluoroethylene, polyacetal, acrylic acid ester copolymers, aliphatic hydrocarbon resins, polyvinyl alcohol, polybutadiene, polyvinyl acetate, polyvinyl acetal, isoprene resins, ethylene propylene rubber, ethylene-vinyl acetate copolymers, and polyamide resins. In addition, examples of the ablation material include perfluoroether-based polymers (fluoroelastomer) and 4-vinyloxy-1-butene (Butyl Vinyl Ether, BVE) cyclic polymers that are materials having a carbon-oxygen bond in a backbone or a cyclic moiety and not containing a hydrogen atom in chemical composition.

The throat portion 10 is formed with a recessed portion 10*a* that is recessed in a direction along the operating axis 30. The arc extinction assisting portion 11 includes a projecting portion 11*a* that projects in the direction along the operating axis 30 and fits into the recessed portion 10*a*.

A conductor 13 to which a high voltage is applied is connected to each of the fixed arc contact 3 and the moving arc contact 4. When the fixed arc contact 3 and the moving arc contact 4 come into contact with each other, current is injected to the conductors 13. When the fixed arc contact 3 and the moving arc contact 4 are separated from each other, the current is interrupted.

According to the gas circuit breaker 1 described above, as illustrated in FIG. 2, when an arc 12 is generated between the fixed arc contact 3 and the moving arc contact 4, the gas pressure in the puffer chamber 7 is increased by the heat generated due to the generation of the arc 12. The increased gas pressure in the puffer chamber 7 causes the insulating gas in the puffer chamber 7 to be blown out through the opening 7*a* and blown to the arc 12. Consequently, the arc 12 is extinguished.

Here, by the heat generated due to the generation of the arc 12, the arc extinction assisting portion 11 evaporates and thereby generates evaporative gas. Thus, the gas pressure in the puffer chamber 7 further increases and the insulating gas is blown out of the puffer chamber 7 more strongly and blown to the arc 12. Therefore, the arc-extinguishing capability of the gas circuit breaker 1 is improved.

In addition, as illustrated in FIG. 2, the inner surface of the nozzle 8 is located near the point where the arc 12 is generated. In particular, the connecting portion between the fixed portion 9 and the throat portion 10 in such a nozzle 8 is closer to the point where the arc 12 is generated, and the arc extinction assisting portion 11 is provided at the connecting portion. This means that because the arc extinction assisting portion 11 is provided near the point where the arc 12 is generated, the arc-extinguishing capability of the gas circuit breaker 1 is further improved.

In addition, because the recessed portion 10*a* formed on the throat portion 10 and the projecting portion 11*a* of the arc extinction assisting portion 11 fit together, the recessed portion 10*a* and the projecting portion 11*a* function as a fall-off preventing portion that prevents the arc extinction assisting portion 11 from falling off. Because the gas flow generated by the insulating gas blown to the arc 12 is supersonic, the impact of the gas flow may cause the arc extinction assisting portion 11 to fall off the nozzle 8. In the first embodiment, the nozzle 8 and the arc extinction assisting portion 11 are thermally expanded by the heat generated due to the generation of the arc 12, and this increases the degree of close contact between the surface of the recessed portion 10*a* facing away from the operating axis 30 and the surface of the projecting portion 11*a* facing the operating axis 30. Therefore, the arc extinction assisting portion 11 becomes less likely to fall off the nozzle 8. Depending on the magnitude relationship between the coefficient of thermal expansion of the nozzle 8 and the coefficient of thermal expansion of the arc extinction assisting portion 11, in some cases, the arc extinction assisting portion 11 becomes less likely to fall off the nozzle 8 as a result of an increase of the degree of close contact between the surface of the recessed portion 10*a* facing the operating axis 30 and the surface of the projecting portion 11*a* facing away from the operating axis 30.

A mechanism for reducing the volume of the puffer chamber 7 according to the movement of the moving arc contact 4 may be provided so as to further increase the flow rate of the insulating gas blown out of the puffer chamber 7 upon generation of the arc 12.

Figure 3:
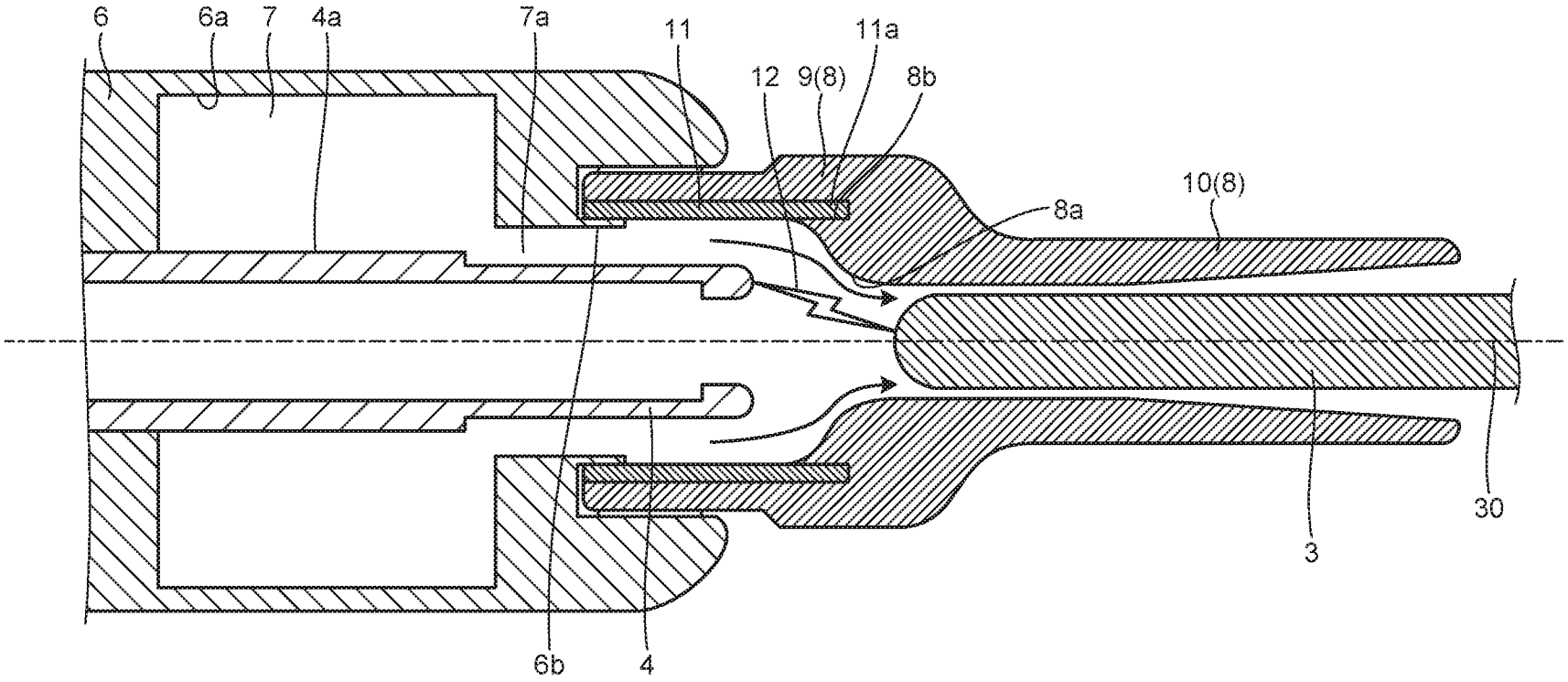
FIG. 3 is a partially enlarged cross-sectional view of a contact portion between a fixed arc contact and a moving arc contact of a gas circuit breaker according to a first variant of the first embodiment.

FIG. 3 is a partially enlarged cross-sectional view of a contact portion between the fixed arc contact 3 and the moving arc contact 4 of a gas circuit breaker according to a first variant of the first embodiment. In the first variant, the arc extinction assisting portion 11 is provided on the inner surface of the fixed portion 9 such that it extends from the end portion on a side closer to the movable-side frame 6 to the end portion on a side closer to the throat portion 10.

The nozzle 8 is formed with a recessed portion 8*b* that is recessed in the direction along the operating axis 30. The arc extinction assisting portion 11 includes the projecting portion 11*a* that fits into the recessed portion 8*b* and the movable-side frame 6 includes an abutting portion 6*b* that abuts on the arc extinction assisting portion 11 from the side where the operating axis 30 is present. In the first variant, the recessed portion 8*b*, the projecting portion 11*a*, and the abutting portion 6*b* form a fall-off preventing portion that prevents the arc extinction assisting portion 11 from falling off.

In the first variant, the abutting portion 6*b* abuts on the arc extinction assisting portion 11 also on the side where the movable-side frame 6 is present, and thus, the falling-off of the arc extinction assisting portion 11 can be more reliably prevented.

Figure 4:
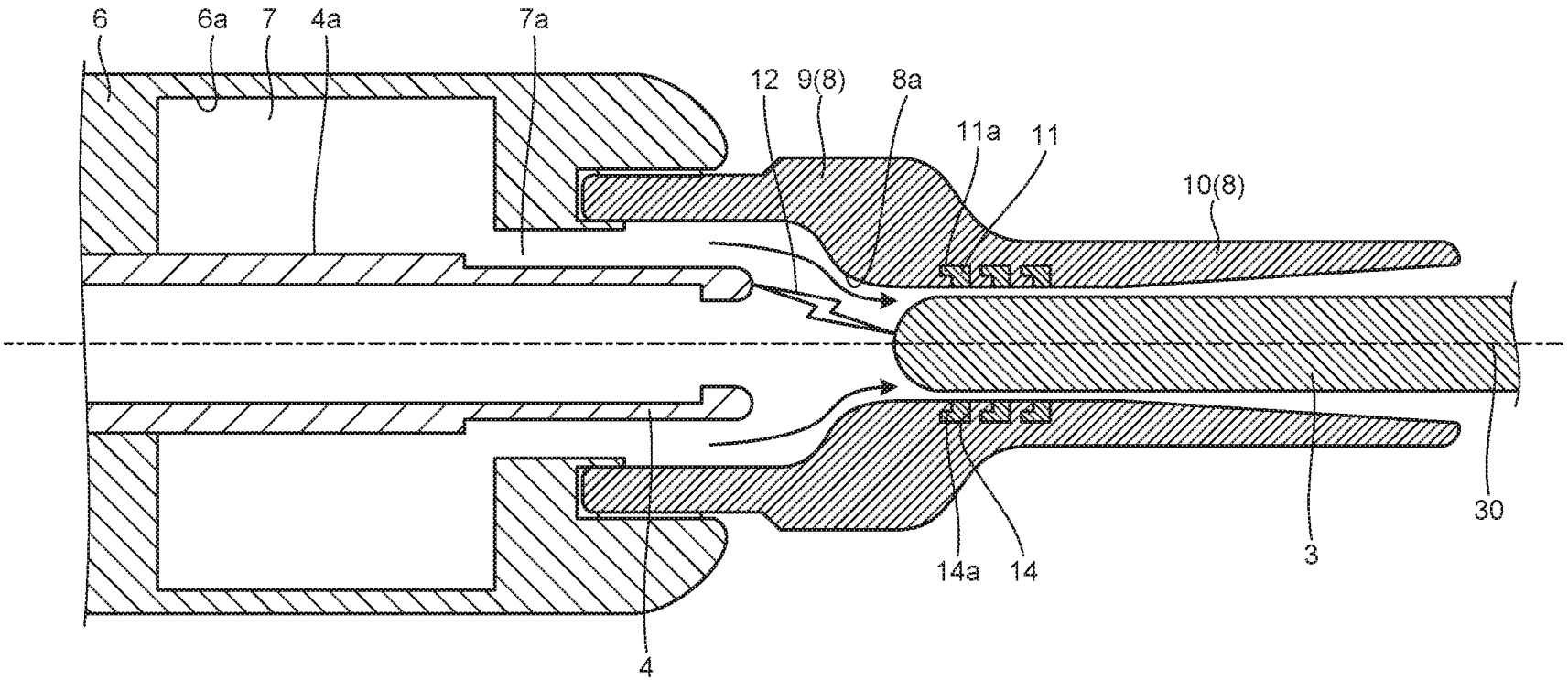
FIG. 4 is a partially enlarged cross-sectional view of a contact portion between a fixed arc contact and a moving arc contact of a gas circuit breaker according to a second variant of the first embodiment.

FIG. 4 is a partially enlarged cross-sectional view of a contact portion between the fixed arc contact 3 and the moving arc contact 4 of a gas circuit breaker according to a second variant of the first embodiment. In the second variant, the arc extinction assisting portions 11 are embedded in holes 14 formed in the inner surface of the throat portion 10. The holes 14 each consist of a groove extending in the circumferential direction of the throat portion 10, and the holes 14 are arranged side by side in the direction along the operating axis 30.

A recessed portion 14*a* that is recessed in the direction along the operating axis 30 is formed on the interior wall surface of each hole 14. Each arc extinction assisting portion 11 includes the projecting portion 11*a* that fits into the recessed portion 14*a*. In the second variant, the recessed portion 14*a* and the projecting portion 11*a* form a fall-off preventing portion that prevents the arc extinction assisting portion 11 from falling off. Note that the holes 14 in which the arc extinction assisting portions 11 are embedded may be formed in the inner surface of the fixed portion 9.

Figure 5:
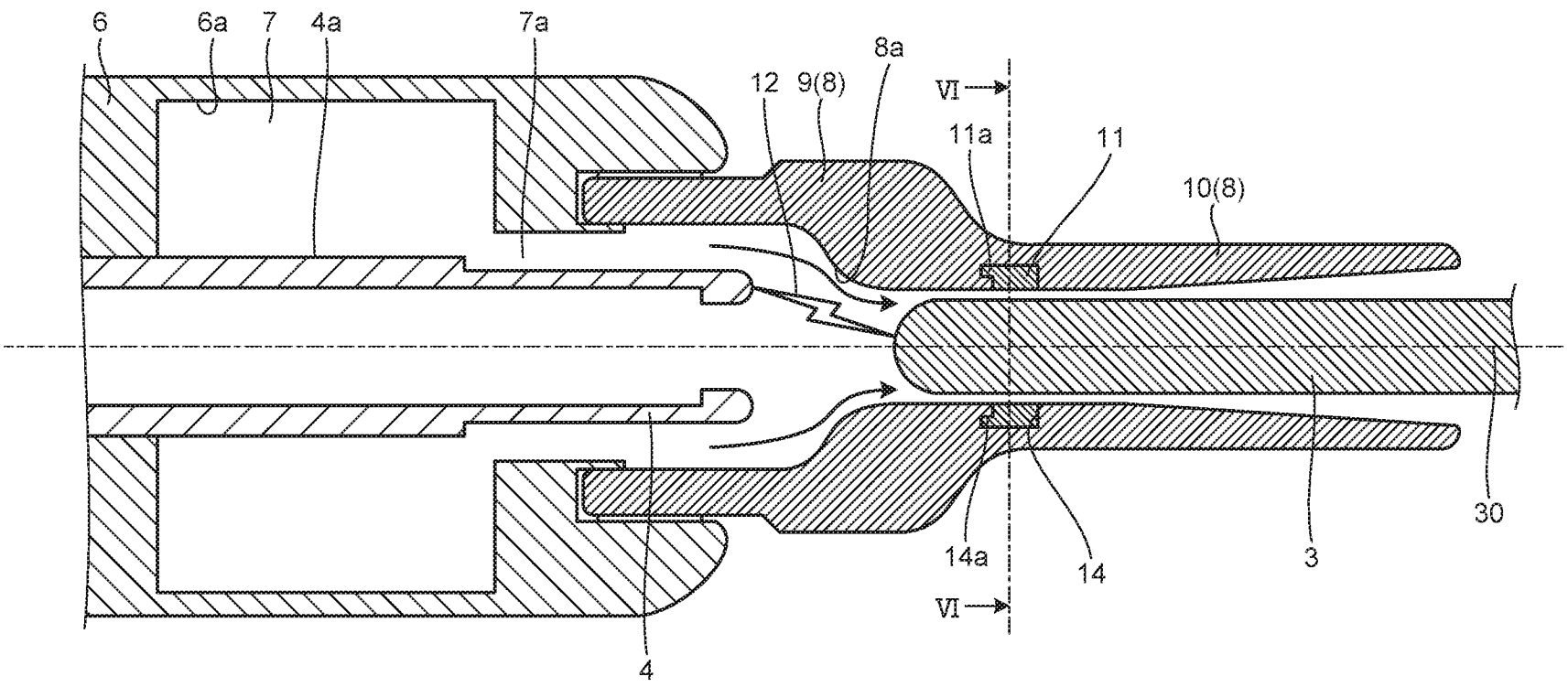
FIG. 5 is a partially enlarged cross-sectional view of a contact portion between a fixed arc contact and a moving arc contact of a gas circuit breaker according to a third variant of the first embodiment.
Figure 6:
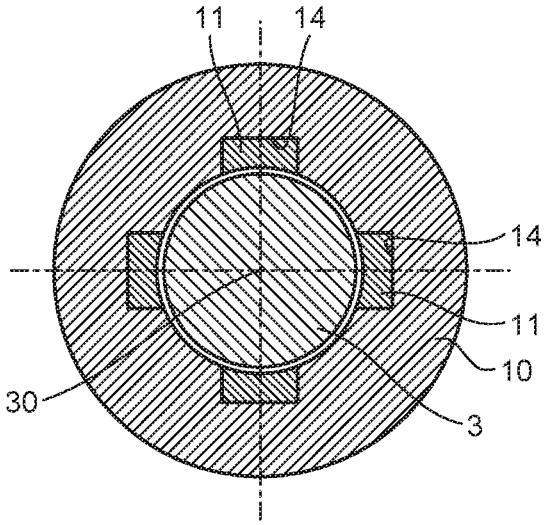
FIG. 6 is a cross-sectional view taken along line VI-VI illustrated in FIG. 5.

FIG. 5 is a partially enlarged cross-sectional view of a contact portion between the fixed arc contact 3 and the moving arc contact 4 of a gas circuit breaker according to a third variant of the first embodiment. FIG. 6 is a cross-sectional view taken along line VI-VI illustrated in FIG. 5. In the third variant, instead of providing a plurality of the arc extinction assisting portions 11 in the direction along the operating axis 30 as in the above-described second variant, as illustrated in FIG. 6, a plurality of the arc extinction assisting portions 11 are provided side by side in the circumferential direction of the inner surface of the nozzle 8. In the third variant, a plurality of the holes 14 are formed side by side in the inner surface of the throat portion 10 in the circumferential direction, and the arc extinction assisting portions 11 are embedded in the holes 14.

As in the above-described second variant, the recessed portion 14*a* that is recessed in the direction along the operating axis 30 is formed on the interior wall surface of each hole 14. In addition, each arc extinction assisting portion 11 includes the projecting portion 11*a* that fits into the recessed portion 14*a*. In addition, as in the above-described second variant, the recessed portion 14*a* and the projecting portion 11*a* form a fall-off preventing portion that prevents the arc extinction assisting portion 11 from falling off. Note that the holes 14 in which the arc extinction assisting portions 11 are embedded may be formed in the inner surface of the fixed portion 9.

Figure 7:
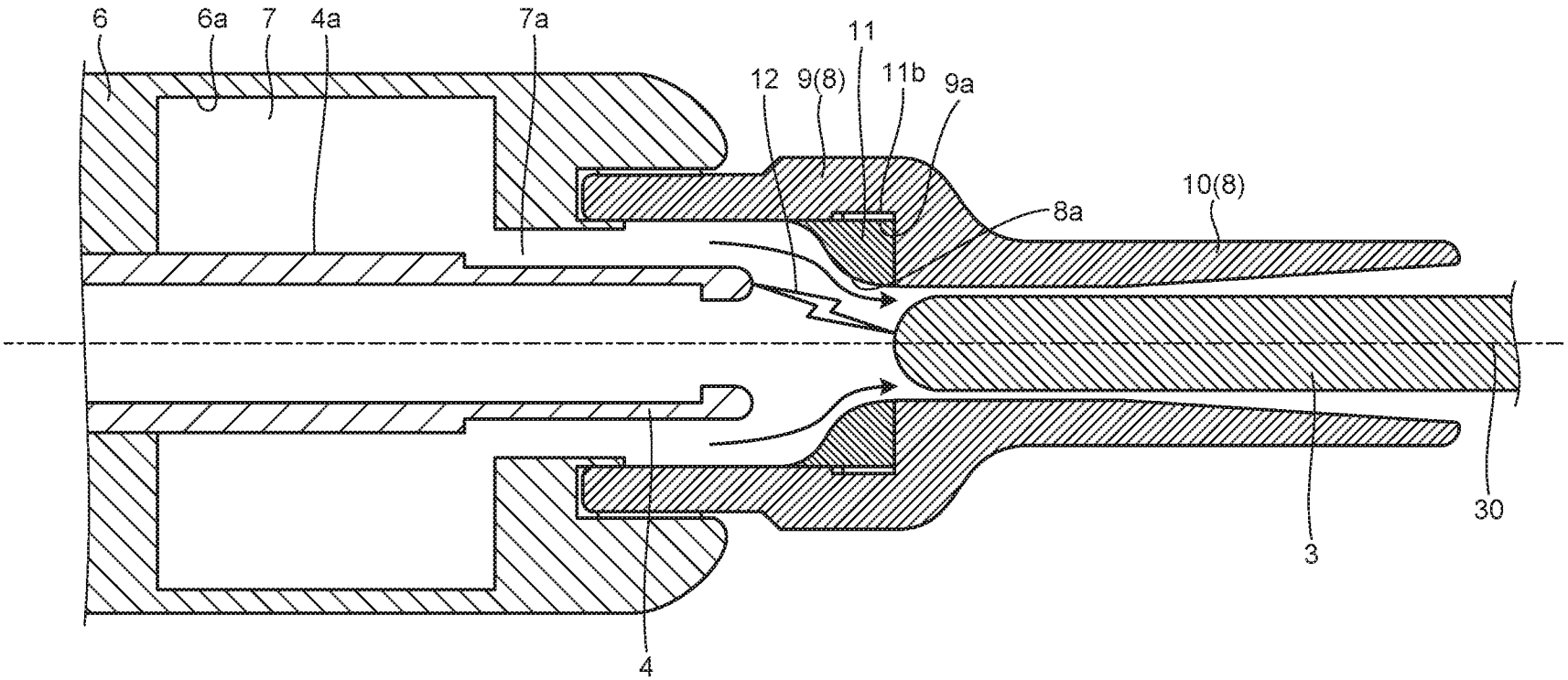
FIG. 7 is a partially enlarged cross-sectional view of a contact portion between a fixed arc contact and a moving arc contact of a gas circuit breaker according to a fourth variant of the first embodiment.

FIG. 7 is a partially enlarged cross-sectional view of a contact portion between the fixed arc contact 3 and the moving arc contact 4 of a gas circuit breaker according to a fourth variant of the first embodiment. In the fourth variant, the arc extinction assisting portion 11 is provided at the same location as that in the example illustrated in FIG. 2. In addition, part of the arc extinction assisting portion 11 forms the connecting surface 8*a*.

In the fourth variant, an internal thread 9*a* is formed on the inner surface of the fixed portion 9, and an external thread 11*b* is formed on the outer surface of the arc extinction assisting portion 11. The arc extinction assisting portion 11 is screwed into the fixed portion 9; therefore, the internal thread 9*a* meshes with the external thread 11*b*. Consequently, the arc extinction assisting portion 11 is fixed to the inside of the fixed portion 9. In the fourth variant, the internal thread 9*a* formed on the fixed portion 9 and the external thread 11*b* formed on the arc extinction assisting portion 11 form a fall-off preventing portion.

The configurations shown in the above-described embodiments show examples of an aspect of the present invention and can also be combined with other publicly known techniques, or part of the configurations can also be omitted or changed without departing from the scope of the present invention.

REFERENCE SIGNS LIST

1 gas circuit breaker; 2 tank; 3 fixed arc contact; 4 moving arc contact; 4*a* outer surface; 5 fixed-side frame; 6 movable-side frame; 6*a* inner surface; 6*b* abutting portion; 7 puffer chamber; 7*a* opening; 8 nozzle; 8*a* connecting surface; 8*b* recessed portion; 9 fixed portion; 9*a* internal thread; 10 throat portion; 10*a* recessed portion; 11 arc extinction assisting portion; 11*a* projecting portion; 11*b* external thread; 12 arc; 13 conductor; 14 hole; 14*a* recessed portion; 30 operating axis.

The invention claimed is:

1. A gas circuit breaker comprising:

a fixed arc contact extending along an operating axis;

a moving arc contact allowed to move to a position where the moving arc contact contacts the fixed arc contact and a position where the moving arc contact is separated from the fixed arc contact by moving along the operating axis;

a frame surrounding a circumference of the moving arc contact to form a puffer chamber around the moving arc contact;

a nozzle having a cylindrical shape centered on the operating axis, the nozzle being fixed to the frame and projecting in a direction toward the fixed arc contact from the moving arc contact; and an arc extinction assisting portion provided on an inner surface of the nozzle and made of an ablation material, wherein the nozzle and the arc extinction assisting portion are provided with a fall-off preventing portion to prevent the arc extinction assisting portion from falling off the nozzle, the nozzle includes a fixed portion having a cylindrical shape centered on the operating axis and fixed to the frame, and a throat portion having a cylindrical shape centered on the operating axis and extending from the fixed portion toward a side where the fixed arc contact is present along the operating axis, an inner diameter of the throat portion is smaller than an inner diameter of the fixed portion, the arc extinction assisting portion forms a connecting surface that connects an inner surface of the throat portion to an inner surface of the fixed portion, and the fall-off preventing portion includes a recessed portion formed on the throat portion and recessed in a direction along the operating axis, and a projecting portion of the arc extinction assisting portion, the projecting portion being fitted into the recessed portion.

2. A gas circuit breaker comprising:

a fixed arc contact extending along an operating axis;

a moving arc contact allowed to move to a position where the moving arc contact contacts the fixed arc contact and a position where the moving arc contact is separated from the fixed arc contact by moving along the operating axis;

a frame surrounding a circumference of the moving arc contact to form a puffer chamber around the moving arc contact;

a nozzle having a cylindrical shape centered on the operating axis, the nozzle being fixed to the frame and projecting in a direction toward the fixed arc contact from the moving arc contact; and an arc extinction assisting portion provided on an inner surface of the nozzle and made of an ablation material, wherein the nozzle and the arc extinction assisting portion are provided with a fall-off preventing portion to prevent the arc extinction assisting portion from falling off the nozzle, the nozzle includes a fixed portion having a cylindrical shape centered on the operating axis and fixed to the frame, and a throat portion having a cylindrical shape centered on the operating axis and extending from the fixed portion toward a side where the fixed arc contact is present along the operating axis, the arc extinction assisting portion is provided on an inner surface of the fixed portion such that the arc extinction assisting portion extends from an end portion on a side closer to the frame to an end portion on a side closer to the throat portion, and the fall-off preventing portion includes a recessed portion formed on the nozzle and recessed in a direction along the operating axis, a projecting portion of the arc extinction assisting portion, the projecting portion being fitted into the recessed portion, and an abutting portion of the frame, the abutting portion abutting on the arc extinction assisting portion from a side where the operating axis is present.

3. A gas circuit breaker according to claim 1, wherein comprising:

a fixed arc contact extending along an operating axis;

a moving arc contact allowed to move to a position where the moving arc contact contacts the fixed arc contact and a position where the moving arc contact is separated from the fixed arc contact by moving along the operating axis;

a frame surrounding a circumference of the moving arc contact to form a puffer chamber around the moving arc contact;

a nozzle having a cylindrical shape centered on the operating axis, the nozzle being fixed to the frame and projecting in a direction toward the fixed arc contact from the moving arc contact; and an arc extinction assisting portion provided on an inner surface of the nozzle and made of an ablation material, wherein the nozzle and the arc extinction assisting portion are provided with a fall-off preventing portion to prevent the arc extinction assisting portion from falling off the nozzle, the arc extinction assisting portion is embedded in a hole formed in the inner surface of the nozzle, and the fall-off preventing portion includes a recessed portion formed on an interior wall surface of the hole and recessed in a direction along the operating axis, and a projecting portion of the arc extinction assisting portion, the projecting portion being fitted into the recessed portion.

4. The gas circuit breaker according to claim 3, wherein a plurality of the holes and a plurality of the arc extinction assisting portions are provided side by side in the direction along the operating axis.

5. The gas circuit breaker according to claim 4, wherein the hole and the arc extinction assisting portion are formed in the throat portion.

6. The gas circuit breaker according to claim 3, wherein a plurality of the holes and a plurality of the arc extinction assisting portions are provided side by side in a circumferential direction of the inner surface of the nozzle.

7. The gas circuit breaker according to claim 6, wherein the hole and the arc extinction assisting portion are formed in the throat portion.

8. The gas circuit breaker according to claim 3, wherein the hole and the arc extinction assisting portion are formed in the throat portion.

9. A gas circuit breaker comprising:

a fixed arc contact extending along an operating axis;

a moving arc contact allowed to move to a position where the moving arc contact contacts the fixed arc contact and a position where the moving arc contact is separated from the fixed arc contact by moving along the operating axis;

a frame surrounding a circumference of the moving arc contact to form a puffer chamber around the moving arc contact;

a nozzle having a cylindrical shape centered on the operating axis, the nozzle being fixed to the frame and projecting in a direction toward the fixed arc contact from the moving arc contact; and an arc extinction assisting portion provided on an inner surface of the nozzle and made of an ablation material, wherein the nozzle and the arc extinction assisting portion are provided with a fall-off preventing portion to prevent the arc extinction assisting portion from falling off the nozzle, and the fall-off preventing portion includes an internal thread formed on the inner surface of the nozzle, and an external thread formed on an outer surface of the arc extinction assisting portion and meshed with the internal thread.

* * * * *